United States Patent [19]

Dickson

[11] 4,080,085

[45] Mar. 21, 1978

[54] TRAFFIC LANE DELINEATOR SYSTEM

[75] Inventor: Arthur D. Dickson, St. Paul, Minn.

[73] Assignee: Minnesota Mining and Manufacturing Company, St. Paul, Minn.

[21] Appl. No.: 818,801

[22] Filed: Jul. 25, 1977

Related U.S. Application Data

[63] Continuation-in-part of Ser. No. 655,290, Feb. 4, 1976, abandoned.

[51] Int. Cl.[2] ..... E01F 9/08

[52] U.S. Cl. ..... 404/14; 357/17; 362/235

[58] Field of Search ..... 404/15, 14, 16, 9; 350/97; 116/63 R; 357/72, 73, 17; 240/10 R, 10 T

[56] References Cited

U.S. PATENT DOCUMENTS

| | | | |
|---|---|---|---|
| 2,876,326 | 3/1959 | Akmentin | 404/17 X |
| 3,164,071 | 1/1965 | Rubenstein | 404/10 |
| 3,737,647 | 6/1973 | Gomi | 357/17 X |
| 3,836,275 | 9/1974 | Finch | 404/13 |
| 3,873,880 | 3/1975 | Riddell | 240/10 T X |
| 3,879,148 | 4/1975 | Eigenmann | 404/14 X |
| 3,894,225 | 7/1975 | Chao | 240/10 R X |
| 3,920,346 | 11/1975 | Wyckoff | 404/14 |

*Primary Examiner*—Nile C. Byers

*Attorney, Agent, or Firm*—Cruzan Alexander; Donald M. Sell; William B. Barte

[57] ABSTRACT

A system for providing internally illuminated traffic lane delineators is disclosed. This system includes a delineator device adapted for use with a traffic lane marking film comprising a flexible and pliable polymeric material exhibiting cold flow and reduced elasticity such as unvulcanized rubber. Such a film conforms into intimate contact with a road surface under the influence of road traffic and stays in that deformed state. An array of electrical conductors is embedded within and extends the length of the film. The delineator device includes an electric lamp, a housing enclosing the lamp and a flexible sheet-like body comprising a polymeric material similar to that included in the film. A plurality of such devices may be readily affixed at any desired location along the length of the film by soldering leads from the electric lights to the conductors in the film and by adhering the sheetlike body to the film surface.

15 Claims, 4 Drawing Figures

TRAFFIC LANE DELINEATOR SYSTEM

REFERENCE TO RELATED PATENT APPLICATION

This application is a continuation-in-part of U.S. Ser. No. 655,290, which application was filed Feb. 4, 1976, now abandoned.

BACKGROUND OF THE INVENTION

1. Field of the Invention

This invention relates to roadway marking devices, particularly to such devices having internal light sources.

2. Description of the Prior Art

The need to alert motorists of the limits of a roadway and of oncoming road hazards has been longstanding, and has been accentuated with the development of multi-lane high speed highways. In particular, the need to mark traffic lanes has long been appreciated, and various marking techniques have typically included strips of white paint, paint having retro-reflective glass beads mixed therein, as well as raised pavement marker devices which are secured to the roadway at spaced intervals and which include a high efficiency reflector. All such devices suffer the disadvantage that they are not internally illuminated, i.e., that they only become visible when light from an oncoming vehicle is directed toward the device and is reflected therefrom, and thus in many situations do not adequately alert motorists approaching a hidden hazard such as a sudden left turn.

Internally illuminated marker devices to extend the region of visibility have also been previously suggested. For example, U.S. Pat. No. 3,836,275 (Finch) discloses a marking system in which a flexible molded strip of resilient material has disposed therein electrical conductors which may be utilized to power self-illuminating light sources inserted into recesses in the strip. A major limitation of this and other prior art self-illuminated devices is that the roadway must be cut away to allow installation of electrical lines. Generally, a source of electrical power such as conventional utility power lines must also be available nearby. The high cost of such installations has precluded the use of such devices in all except very high hazard areas such as airport runways.

SUMMARY OF THE INVENTION

In contrast to such prior art traffic control devices in which external electrical power must be supplied via electrical leads embedded into the roadway, the present invention provides an electrically operated lane marker intended for application directly to road surfaces, without any modification thereof, thus effecting a major cost savings in the installation.

The traffic lane delineator device of the present invention is adapted for use with a traffic lane delineator film, which film comprises a flexible and pliable polymeric material exhibiting limited cold flow and reduced elasticity such that the film deforms into intimate conformation with a road surface under the influence of road traffic and remains in that conformed state. The film has an array of electrical conductors embedded therein, which array extends the length thereof such that the conductors are normally electrically insulated and protected from environmental exposure, but may also be readily exposed at any location along the length of the film to allow electrical connection thereto. The film is adapted for use with electrical devices which may be electrically connected and adherently mounted with the film.

The traffic lane delineator light emitting device of the present invention includes an electric lamp, a molded plastic housing enclosing the lamp and having an extended substantially planar base portion and a portion projecting from a center section of the base portion enabling light produced by the lamp to be transmitted therethrough while providing protection for the lamp from environmental exposure and traffic impact. The base portion of the housing is surrounded and sandwiched within a flexible pliable sheet-like body comprising a polymeric material of the same general composition as that of the film. The sheet-like body further has openings through which the projecting portion of the housing and the electrical leads of the lamp protrude. Electrical leads from a plurality of such devices are readily connected to the conductors of the film and the bodies of such devices adhered to the film to provide sealed mountings of the devices at any desired location along the film. The same compositions of the body and the film thus facilitate ready adherence of the sheet-like body to the film, which adherence and sealed mounting is maintained during mutual deformation as a result of traffic impact. Preferably, the sheet-like body extends beyond the base portion of the housing so as to provide an extended area which may be bonded to the traffic lane marking film, thus ensuring firm bonding so as to prevent dislodgement of the device even under prolonged and severe traffic exposure. The extended area is preferably at least three times the area of the base portion, and may typically be approximately four times the area of the base portion.

A particularly preferred polymeric material desirably used in the construction of the film and light emitting devices described above includes unvulcanized rubber. Such a material exhibits a high but properly limited degree of cold flow such that when it is adhered to a road surface with a contact adhesive such as a neoprene adhesive together with suitable solvents, it readily and permanently conforms to irregularities in the road surface to provide a firm mechanical as well as adhesive bond which is resistant to removal even under severe conditions. Yet the cold flow is not so excessive as to permit undue flow, creep or distortion under ambient temperatures and pressures such that the position of the material on a road surface will be radically altered.

Since the light emitting device may be affixed and electrically connected to the film at any location along the length of the film, a great degree of adaptability to meet the needs of a given installation is provided at a relatively low cost. In a further embodiment, the present invention includes means such as conduits, voltage stepdown transformers, and the like for applying electrical power to the array of conductors.

DESCRIPTION OF THE PREFERRED EMBODIMENTS

Figure 1:
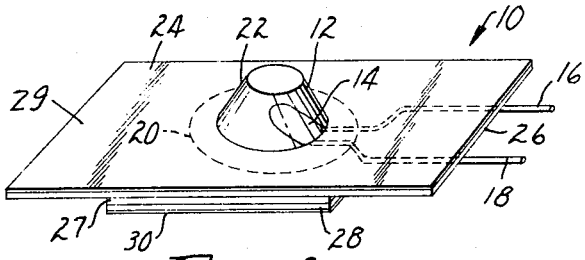
FIG. 1 is a perspective view of one of the light sources forming a part of the present invention.

A preferred embodiment of the traffic lane delineator device of the present invention is shown in perspective view in FIG. 1. As may there be seen, the device 10 includes a housing 12 within which is mounted an electric lamp 14 having leads 16 and 18 extending therefrom. The housing 12 includes a base portion 20 and a generally transparent or translucent raised portion 22 through which light emitted by the electric lamp 14 may be transmitted. A flexible pliable sheet-like body 24 surrounds an extended base portion of the housing, such that the base portion is sandwiched therein and allows the raised portion 22 of the housing 12 and the leads 16 and 18 of the lanp 14 to protrude. The body 24 is preferably constructed from three sheets 26, 27 and 28, respectively, of unvulcanized rubber. The top sheet 26 is provided with an opening for the raised portion 22 of the housing and is sealed to the upper surface of the base portion of the housing 12 and to the bottom sheet 28, which in turn extends across and is sealed to the bottom of the base portion 20 so as to completely seal the housing therebetween. The middle sheet 27 is provided with a hole in the center to receive the base portion of the housing 12 and provides a more gradual transition around the periphery of the housing so as to improve the seal between the top and bottom sheets 26 and 28. In order to ensure that the outer surfaces of the layers 26 and 28 remain clean and do not undesirably adhere to other objects during shipment and the like, release liners 29 and 30 are provided on the surfaces of the layers 26 and 28, respectively, which liners are removed prior to applying the device during installations.

As shown in FIG. 1 (and also in FIGS. 3 and 4 discussed hereinafter), the sheet-like body 24 preferably extends beyond the base portion 20 of the housing so as to provide an extended area for contact and bonding to the lane marking film. The extended area of the body 24 is preferably three times the area of the base portion 20, and may desirably be approximately four times the area of the base portion. The exact amount desired may vary depending upon the specific installation. Clearly an excess amount would be wasteful, while for seldom used areas or protected installations not subjected to severe traffic, a smaller relative area is satisfactory. In a preferred embodiment, the extended base portion of the housing 12 has been constructed to be approximately 3 inches (7.6 cm) in diameter, the film is approximately 4 inches (10 cm) wide, and the extended sheet-like body 24 approximately 4 × 7 inches (10 × 17.8 cm), resulting in a ratio of respective areas of approximately four.

Figure 2:
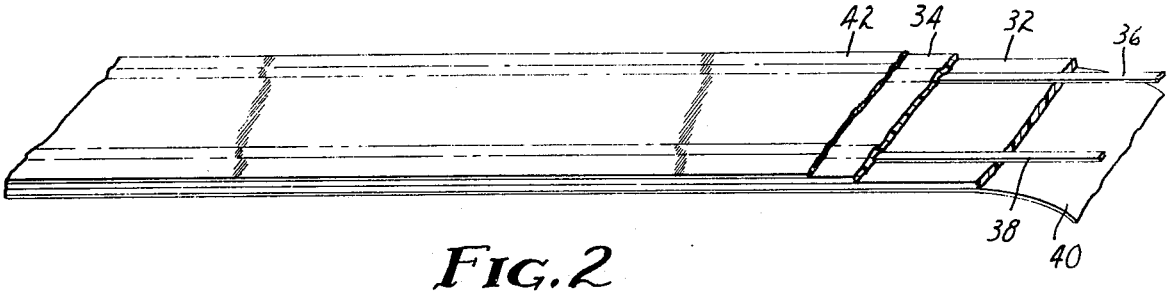
FIG. 2 is a partially cut-away view of the film portion of the present invention.

A partially cut-away view of a traffic lane delineator film preferably used in the present invention is shown in FIG. 2. As is there set forth, the film is preferably constructed from two strips 32 and 34, laminated together and having, as an array of electrical conductors, two flat conductors 36 and 38 extending along the length of the strips 32 and 34. Each of the conductors 36 and 38 is preferably equivalent to an AWG wire size No. 16, and is preferably pretinned to promote ease in soldering the leads such as leads 16 and 18 of the lamp 14 to the conductors 36 and 38. Further, it has been found that the pretinning tends to anneal the conductors, improving the conformability of the film to a road surface. The strips 32 and 34 are laminated together such as with a conventional neoprene adhesive and thereby provide electrical insulation and environmental protection for the conductors 36 and 38. Release liners 40 and 42 are also preferably provided on the exposed surfaces of the strips 32 and 34 so as to maintain the surfaces of the film clean and to prevent undesirable adhering of the surfaces to opposite surfaces of the film such as when the film is shipped in a rolled-up form.

The composition of the layers 32 and 40 is primarily unvulcanized rubber; however, additional fillers and extenders such as asbestos, pigments and glass beads may also be included. For example, to increase the conspicuity of the film when used in lane marking applications, the composition of the layers 32 and 40 is desirably modified to contain a white pigment. Alternatively, where the film is provided to facilitate connection of the conductors 32 and 38 from a lane marking film to appropriate electrical sources along the side of a roadway, the layers 32 and 40 may desirably contain a gray or black pigment such that the film blends with the road surface. Similar films may likewise be formed via extrusion and other conventional techniques.

Figure 3:
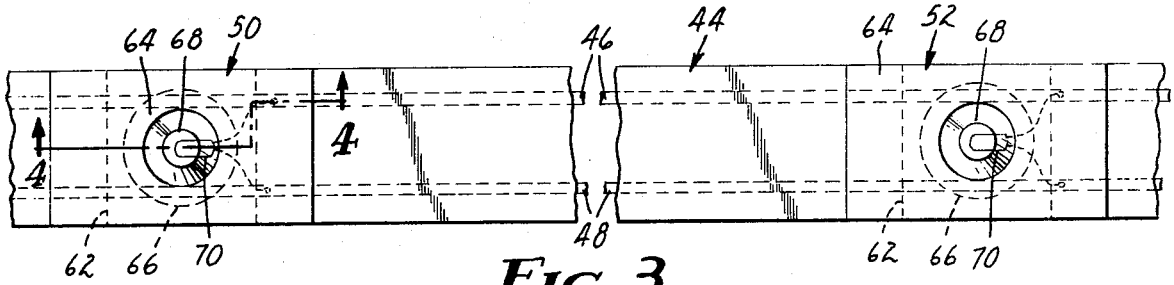
FIG. 3 is a top view of the film showing two light sources assembled thereon.

A portion of a film and light source combination such as typically used in a road installation is shown in FIG. 3. In this figure, a film 44 containing a pair of electrical conductors 46 and 48 is shown to have two light sources 50 and 52 secured thereto. Each of the light sources 50 and 52 include a housing and an electrical lamp as set forth in FIG. 1, and are adhered to the film 44 with the electrical leads from each of the lamps soldered to the electrical conductors 46 and 48. The film 44 is desirably provided in lengths up to 500 feet. A maximum of 20 light sources would typically be provided for application at desired intervals along the length of the film.

In a typical installation, the film 44 is cut to a desired length, depending upon the length of lane to be delineated. The release liner along one surface of the film is removed. A contact adhesive such as a neoprene based adhesive, modified with a slow drying solvent to provide a longer drying time, is applied to the exposed surface and to a desired portion of a road surface. The film is pressed onto the coated portion of a road surface and normal traffic is allowed to further press the film into the surface to provide a firm mechanical, as well as adherent bond of the film to the road surface. No treatment of the road surface such as cutting a groove or modifying the road surface is required, other than ensuring that the surface is reasonably free of debris. The light sources 50 and 52 are then attached to the film 44 at desired intervals. For example, where conventional lane markings are desired, adjacent lamps may be attached at 50-foot spacings, i.e., as many as 10 lamps in a 500-foot length may be utilized. In other applications where directional information is to be provided, the light sources may obviously be placed at closer intervals as desired.

To install a light source such as sources 50 and 52 to the film 44, a small portion of the film on top of the conductors 36 and 38 is peeled away to expose the conductors. The electric lamp leads, such as leads 16 and 18 of the light source shown in FIG. 1, are soldered to the conductors 46 and 48. The release liner on the light sources, such as layer 30, is removed, a layer of contact adhesive applied to the bottom of the layers 26 and 28 and to the top surface of the film, and the light source is pressed against the top surface, thereby forming a tight adherent bond to the film, electrically insulating the leads 16 and 18 therebetween.

Figure 4:
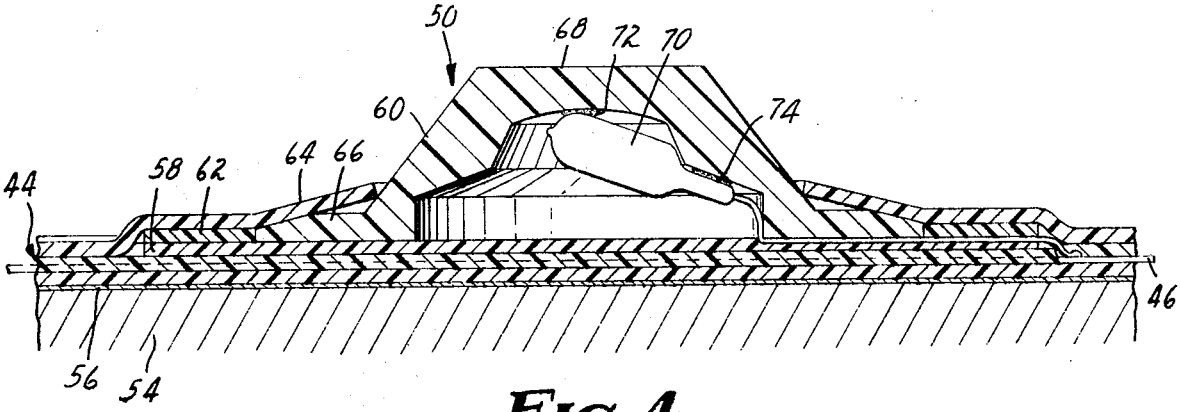
FIG. 4 is a cross sectional view of one of the lamp housings and film shown in FIG. 3.

A cross section of the light source 50 taken across lines 4—4 are shown in FIG. 4. As is there clearly shown, the film 44 is secured to a road surface 54 via a thin layer of adhesive 56. The light source 50 is secured to the film 44 via a layer of neoprene adhesive (not shown) extending between the bottom of the layers of unvulcanized rubber 58 and 64 and the top surface of the film 44. The layer of unvulcanized rubber 62 is provided around the housing 60 to minimize the irregularity between the bottom layer of unvulcanized rubber 58 and the top covering layer 64. In an alternative construction, the body of polymeric material may be extruded, molded or the like around the housing 60.

The housing 60 is provided with base portion 66, thus facilitating a weather-tight seal of the housing 60 between the top and bottom layers 64 and 58 respectively. The housing 60 also includes a portion 68 which projects above the top layer of unvulcanized rubber 64 such that light from an electric lamp 70 within the housing 60 may be transmitted. The lamp 70 is positioned within the housing 60 by a small amount of an adhesive such as silicone adhesive applied inside the top and side of the housing such as at locations 72 and 74.

The housing 60 is preferably formed of a molded thermoplastic material such as polycarbonate, polybutyrate, or polymethylmethacrylate and may also be filled with fiber glass or the like for greater structural strength. For omnidirectional lane markers, the housing 60 is preferably transparent or translucent throughout. Alternatively, where directional light is desired, such as in providing one-way lane indications, one portion of the housing 60 may be formed of a non-light transmitting material while another portion is formed of a light transmitting material. Similarly, portions of the housing may be painted or otherwise made non-transmitting.

The electric lamp 70 is preferably a ruggedized incandescent lamp such as General Electric Types 124, 161 or 194, which are generally designed for automotive instrumentation uses. Such lamps are designed for use at low voltages and are preferred for use with the present invention, inasmuch as the insulation requirements and hazards of using such devices on road surfaces are then minimized. In order to minimize variations in the intensity of the light sources along the length of a section of applied film, it is preferred to limit the number of light sources along a given length, i.e., with No. 16 AWG conductors in the film, no more than 10 light sources are desirably provided in a 500-foot section. The intensity is further maintained uniform by using a constant voltage transformer to provide power to the film, thus ensuring that a constant potential is applied, regardless of the load, i.e., regardless of the number of sources secured to the film or of nominal leakage currents resulting from moisture or the like.

Having thus described the present invention, what is claimed is:

1. A traffic lane delineator device adapted for use with a traffic lane marking film comprising a pliable polymeric material exhibiting limited cold flow and reduced elasticity characteristics such that when the film is subjected to vehicle traffic, the film is pressed into and deformed to intimately conform and adhere to the road surface, said film including an array of electrical conductors embedded therein and extending the length thereof such that the conductors are normally electrically insulated and protected from environmental exposure but may also be readily exposed at any location along the length of the film to allow electrical connection thereto, said device comprising a. an electric lamp, b. a molded plastic housing enclosing said lamp and having an extended substantially planar base portion and a portion projecting from a center section of the base portion enabling light produced by the lamp to be transmitted therethrough while providing protection for the lamp from environmental exposure and traffic impact, and c. a flexible pliable sheet-like body comprising a polymeric material of the same general composition as that of the film, said sheet-like body surrounding the base portion of the housing such that the substantially planar portion is sandwiched therein, said body having openings through which the projecting portion of the housing and electrical leads from the lamp protrude whereby the electrical leads may be readily connected to the conductors of a said film, the same compositions of the body and the film facilitating ready adherence of the body to the film to provide a sealed mounting of the device on the film at any desired location, which adherence and mounting is maintained during mutual deformation as a result of traffic impact.

2. A traffic lane delineator device according to claim 1, wherein said body comprises an unvulcanized elastomeric precursor.

3. A traffic lane delineator device according to claim 2, wherein said body further comprises extender resins, fillers and pigments.

4. A traffic lane delineator device according to claim 3, wherein said body comprises a light-colored pigment designed to contrast with a road surface, thereby facilitating the use of the film as a lane marker.

5. A traffic lane delineator device according to claim 1, wherein said electric lamps comprise light emitting diodes.

6. A traffic lane delineator device according to claim 1, wherein said electric lamps comprise incandescent lamps adapted for severe service applications.

7. A traffic lane delineator device according to claim 1, wherein said housing comprises a molded polycarbonate shell having tapered walls and a generally flat top united to said walls facilitating the passage of vehicles thereover and a base portion integral with said walls and adapted to extend into and to be bonded to said flexible body.

8. A traffic lane delineator device according to claim 1, wherein the area of the sheet-like body surrounding the base portion of the housing is not less than three times the area of the base portion, such that the extended area of the body may be firmly bonded to the traffic lane marking film and thus prevent dislodgment of the device under prolonged and severe traffic exposure.

9. A traffic lane delineator device according to claim 1, wherein the sheet-like body comprises a plurality of sheets of the same general composition integrally bonded together, a top sheet sealed to the upper surface of the base portion of the lamp housing and having an opening through which the center raised portion of the housing may protrude, a middle sheet surrounding the base portion and having substantially the same thickness thereas, so as to provide a cushioned gradual transition about the periphery of the base portion so as to improve the seal between the sheets and to lessen the impact of vehicle traffic which may otherwise result in shearing of the body around the base portion and the subsequent dislodgement of the housing, and a bottom sheet extending across and sealed to the bottom of the base portion of the housing such that the housing is sandwiched within the sheet-like body, said sheets cooperatively extending outward from the base portion and substantially parallel to the plane thereof to facilitate an adhesive bond of the sheet-like body to a road surface over an area which is at least three times that of the area of the base portion.

10. A traffic lane delineator system comprising a film including a pliable polymeric material exhibiting limited cold flow and reduced elasticity characteristics such that when the film is placed on a road surface and subjected to road traffic, the film is pressed into and deformed to intimately conform and adhere with the road surface and remains in that conformed state, said film having embedded therewithin an array of electrical conductors extending the length of the film, said array being thus electrically insulated and protected from environmental exposure and yet readily exposable at any location along the film to allow electrical contacts thereto at that location, and a plurality of light emitting devices, each of which includes an electric lamp enclosed within a molded plastic housing including an extended substantially planar base portion and a portion projecting from a center section of the base portion enabling light produced by the lamp to be transmitted therethrough while protecting the lamp from environmental exposure and traffic impact, and a flexible pliable sheet-like body comprising the same polymeric material as that of the film, said body surrounding the base portion of the housing such that the substantially planar portion is sandwiched therein and having openings through which the projecting portion of the housing and the electrical leads from the lamps protrude, said leads from the electric lamps being adapted to be connected to exposed conductors of said array, the same compositions of the film and the body facilitating adherence of the body to the film to provide a firm mounting and weather-tight seal between the devices and the film at any desired location along the film, which adherence and mounting is maintained during mutual deformation as a result of traffic impact.

11. A traffic lane delineator system according to claim 10, wherein said array of conductors comprises two parallel conductors extending the length of said film, said electric lamps being adapted to be connected in parallel across the two conductors and wherein the system further comprises voltage regulator means for maintaining a substantially constant voltage across the lamps regardless of the number of lamps provided therein.

12. A traffic lane delineator system according to claim 10, wherein said film comprises first and second elongated flexible strips comprised of a said pliable polymeric material having major surfaces thereof bonded together and an array of electrical conductors embedded therewithin at the interface between the strips.

13. A traffic lane delineator system according to claim 10, further comprising another film substantially like the first and further including therein a pigment selected to blend with a road surface whereby the array of conductors within each film may be readily interconnected and said another film installed to facilitate inconspicuous and inexpensive connection of the conductors of the first film to a source of electrical power.

14. A traffic lane delineator system according to claim 10, wherein said film includes a pigment facilitating the use thereof as a lane marker.

15. A traffic lane delineator system comprising a traffic lane marking film comprising a pliable polymeric material exhibiting limited cold flow and reduced elasticity characteristics pressed into and adhered to a road surface such that the film is deformed to intimately conform with the road surface under the influence of road traffic and remains in that conformed state, said film having embedded therein an array of electrical conductors extending along the length of the film, said array of electrical conductors being thereby electrically insulated and protected from environmental exposure, and a plurality of light emitting devices, each of which includes an electric lamp, a molded plastic housing enclosing said lamp and having an extended substantially planar base portion and a portion projecting from a center section of the base portion enabling light produced by the lamp to be transmitted therethrough while providing protection for the lamp from weather and traffic impact, and a flexible pliable sheet-like body comprising said polymeric material surrounding the base portion of said housing such that the substantially planar portion is sandwiched therebetween and having openings through which said projecting portion of the housing and electrical leads from each lamp being connected to the conductor array, the same composition of the film and the body facilitating adherence of the body to the film to provide a sealed mounting of the devices on the film at any desired location thereon, which adherence and mounting is maintained during the mutual deformation as a result of traffic impact.

* * * * *